US006766032B1

(12) United States Patent
Lee et al.

(10) Patent No.: US 6,766,032 B1
(45) Date of Patent: Jul. 20, 2004

(54) VOICE TUBE ASSEMBLY

(75) Inventors: Barry Lee, Santa Cruz, CA (US); Eric R. Bradford, Campbell, CA (US); Kwangsee A. Woo, Scotts Valley, CA (US)

(73) Assignee: Plantronics, Inc., Santa Cruz, CA (US)

( * ) Notice: Subject to any disclaimer, the term of this patent is extended or adjusted under 35 U.S.C. 154(b) by 21 days.

(21) Appl. No.: 10/115,487

(22) Filed: Apr. 2, 2002

(51) Int. Cl.[7] ..... H04R 25/00
(52) U.S. Cl. ..... 381/375; 381/357; 381/376
(58) Field of Search ..... 381/370, 371, 381/372, 374, 375, 376, 367, 361, 357

(56) References Cited

U.S. PATENT DOCUMENTS 2,485,402 A * 10/1949 Olney et al. ..... 381/359
5,581,622 A * 12/1996 Sakurai ..... 381/370
6,141,418 A * 10/2000 Weiser et al. ..... 379/454
6,295,366 B1 * 9/2001 Haller et al. ..... 381/374
2002/0064276 A1 * 5/2002 Winegar ..... 381/376

* cited by examiner

*Primary Examiner*—Curtis Kuntz
*Assistant Examiner*—Brian Ensey
(74) *Attorney, Agent, or Firm*—Peter Hsieh

(57) ABSTRACT

An improved boom adapted for use in or with a headset is disclosed. The boom generally comprises a voice tube having a first entry aperture, a light tube, and a noise reducer. The noise reducer is composed at least partially of a porous plastic material and partially or fully covers the voice tube, the noise canceling tube, and/or the light tube.

17 Claims, 4 Drawing Sheets

VOICE TUBE ASSEMBLY

CROSS-REFERENCE TO RELATED APPLICATIONS

The present patent application is related to the following patent application: "Acoustic Enclosures From Porous, Rigid, Opaque Materials Providing Controllable Acoustic & Air Permeability" (hereinafter, "Porous Materials"), U.S. patent application Ser. No. 10/007,783.

BACKGROUND OF THE INVENTION

1. Technical Field

The present invention relates generally to communication apparatuses, and more particularly to headsets and booms adapted for use with or in headsets.

2. Description of Related Art

Traditional headsets have employed a design in which a microphone is extended from a boom and positioned close to a sound source, such as a user's mouth, in an attempt to achieve sound reception clarity. By positioning the microphone in this manner, effective noise cancellation, which distinguishes between sound waves from a desired sound source versus background noise, may more easily be accomplished than if the microphone were positioned at a greater distance from the sound source.

To achieve noise cancellation, two sound ports are used, with one port facing the sound source and a second port facing away from the sound source. A number of issued patents show prior art relating to noise cancellation.

Increasing proximity of the microphone to the sound source, however, has required increasing or extending the length of the boom, which can lead to an increase the overall weight of the boom. This added weight can be undesirable from a user comfort perspective. In addition, opaque coverings for booms have traditionally been required so as to conceal the aesthetically unpleasant wires and connections between the microphone and earpiece.

Wind and background noise interfere with the proper operation of traditional microphones. To keep wind and background noise from interfering with microphone operation, traditional headsets have used a fabric or foam material as a windsock to filter or reduce some of the noise. This material may not satisfy the aesthetic desires of the user and may not achieve all desired acoustic properties.

Some form of in-use indication has also been a desired feature in headsets. A method for accomplishing this indication is to place a small light source or LED near the end of the boom. This placement can lead to a crowded area if the microphone is also housed in or near the end of the boom. The LED also adds to the overall weight of the boom.

Manufacturing costs for a boom increases with increasing complexity of the boom. Traditional booms are manufactured by placing the microphone and/or LED near the end of the boom. This placement complicates the manufacturing process because more manufacturing steps are required to properly house the microphone and LED.

Therefore, what is desired is a boom and microphone for a headset that has improved acoustic, weight, manufacturing cost and/or aesthetic properties.

BRIEF SUMMARY OF THE INVENTION

In an aspect of the invention, an improved communication apparatus is disclosed. The communication apparatus includes a voice tube having a first entry aperture, a light tube, and a noise reducer. The noise reducer is composed at least partially of a porous plastic material and partially or fully covers the voice tube, the noise canceling tube, and/or the light tube. In a further aspect of the invention, the communication apparatus is a boom adapted for use in a headset.

In another aspect of the invention, the communication apparatus includes a noise canceling tube having a second entry aperture. The second entry aperture may be staggered in relation to the first entry aperture to achieve desired noise cancellation properties.

In another aspect of the invention, the light tube is adapted to transmit light from an online indicator light source.

In a further aspect of the invention, the porous plastic material includes a thinned, concave area that points toward the light tube so as to increase exposure to the transmitted light. In one embodiment, the porous plastic material includes between about 30 percent and about 50 percent void volume.

The porous plastic material may include one or more localized acoustic dampening areas. The localized acoustic dampening areas may be thickened to achieve increased acoustic dampening properties or thinned to achieve decreased acoustic dampening properties. In an embodiment, the porous plastic material includes two localized acoustic dampening areas, each of which is thinned to between about 2 mm and about 3 mm.

As is evident, these are merely examples of various implementations, and numerous other variations of these implementations may also be employed. These and other features and advantages of the present invention will be presented in more detail in the following detailed description and the accompanying figures that illustrate by way of example the principles of embodiments of the invention.

DETAILED DESCRIPTION OF THE PREFERRED EMBODIMENTS

The present invention relates to a novel communication apparatus. The following description is presented to enable any person skilled in the art to make and use the invention. Descriptions of specific applications are provided only as examples. Various modifications to the preferred embodiments will be readily apparent to those skilled in the art, and the general principles defined herein may be applied to other embodiments and applications without departing from the spirit and scope of the invention. Thus, the present invention is not intended to be limited to the embodiments shown, but is to be accorded the widest scope consistent with the principles and features disclosed herein.

Figure 1:
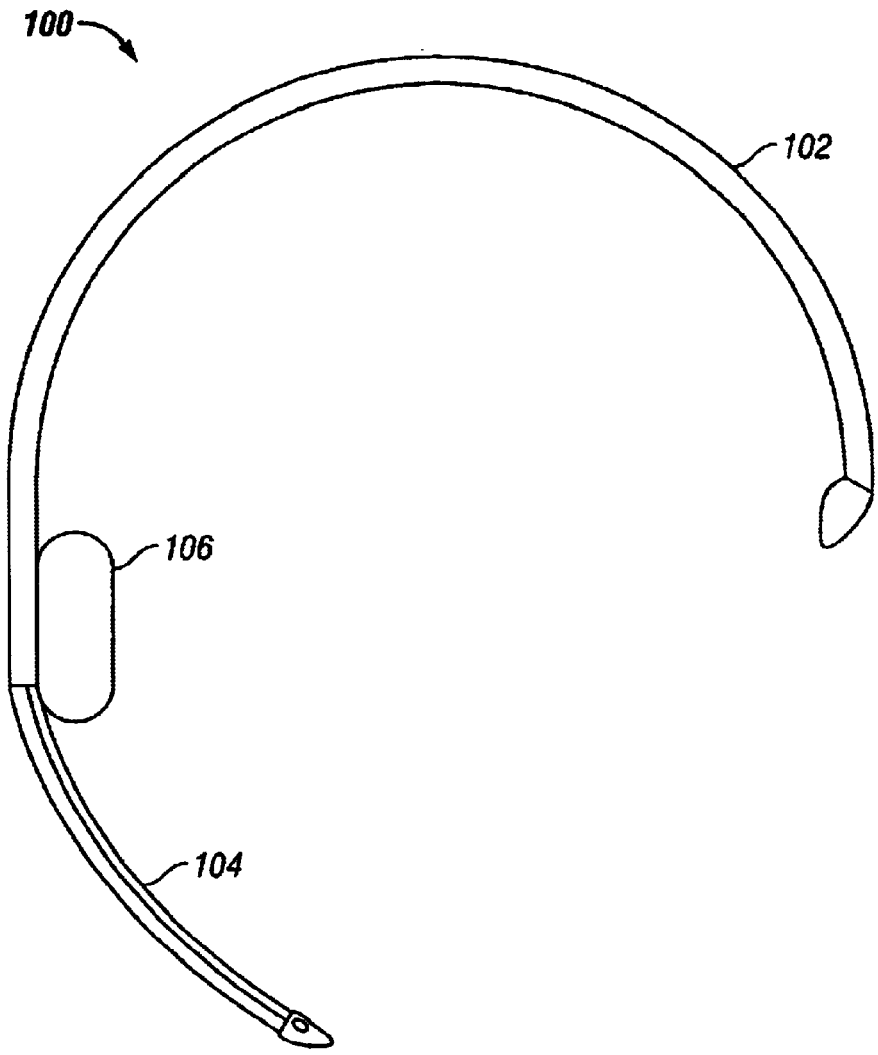
FIG. 1 shows a perspective view of an exemplary headset in accordance with an embodiment of the invention.

FIG. 1 shows a perspective view of an exemplary headset 100 in accordance with an embodiment of the invention. Headset 100 includes headband 102, earpiece 106, and boom 104.

Figure 2:
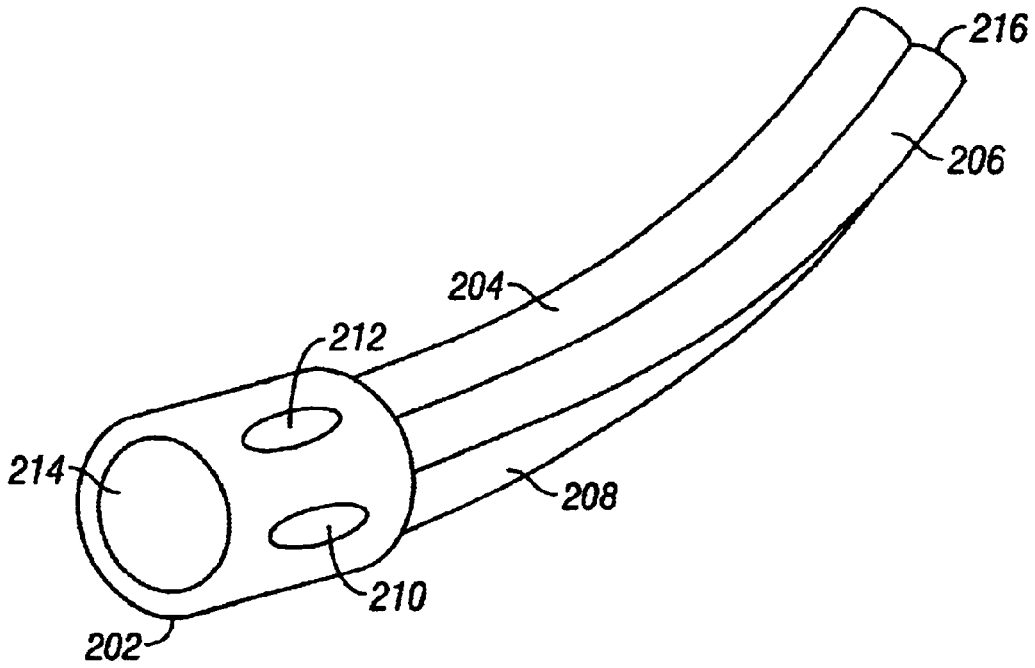
FIG. 2 shows a perspective view of an exemplary boom in accordance with an embodiment of the invention.

FIG. 2 shows a perspective view of an exemplary boom in accordance with an embodiment of the invention. In an embodiment, wind noise reducer 202 covers sound entry points or apertures associated with voice tubes 204, 208. Wind noise reducer 202 may be molded from a porous plastic material such as of a type described in "Porous Materials." The physical properties of the porous plastic material allow sound waves to pass through wind noise reducer 202 into voice tubes 204, 208, but at the same time cutting off wind noise. In addition, the porous plastic material possesses acoustic dampening properties. In an exemplary embodiment of the invention, the porous plastic material creates approximately 330 ohms of acoustic resistance.

In an embodiment of the invention, the acoustic dampening properties of wind noise reducer 202 eliminate the need to employ traditional methods of acoustic dampening, such as through the use of sintered metal coverings or shaped fabrics and gauzes.

Light tube 206 transmits light from one end 216 of the light tube to the other end 214 and casts an "in use" or "online" light on the concave area of end 214 of wind noise reducer 202. For example, a light emitting diode, or LED, may be placed near end 216 of the light tube 206. Light tube 206 is adapted to transmit light from the LED from one end 216 of the light tube 206 to the other end 214, allowing persons in the vicinity of the headset user to know that the user is busy. In an exemplary embodiment, the LED may be lit when the user talks and/or when a dial tone is detected. In one embodiment, the amount of concavity of end 214 may be set to expose the desired amount of light onto the surface of end 214 of wind noise reducer 202. Factors such as light color, LED brightness, and density of the material used affect the amount of light that is exposed on the surface of end 214.

The porous plastic material of wind noise reducer 202 also acts as an effective diffuser of light. In an embodiment of the invention, the diffused light permeates throughout the plastic wind noise reducer 202, in particular through thinned concave area of end 214, to make the "in use" or "online" light more visible to the user and to others who are in the vicinity of the user.

Figure 3:
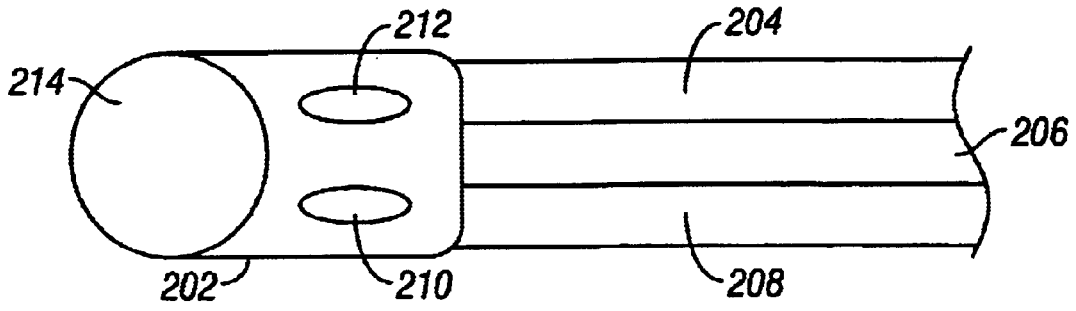
FIG. 3 shows a top view of a boom in accordance with an embodiment of the invention.

FIG. 3 shows a top view of an exemplary boom in accordance with an embodiment of the invention. An exemplary porous plastic wind noise reducer 202 covers or houses parts of tubes 204, 208. Noise reducer 202 may include localized acoustic dampening areas 210, 212 and concave area of end 214. In an embodiment, the surface of concave area of end 214 may be lit during use.

Figure 4:
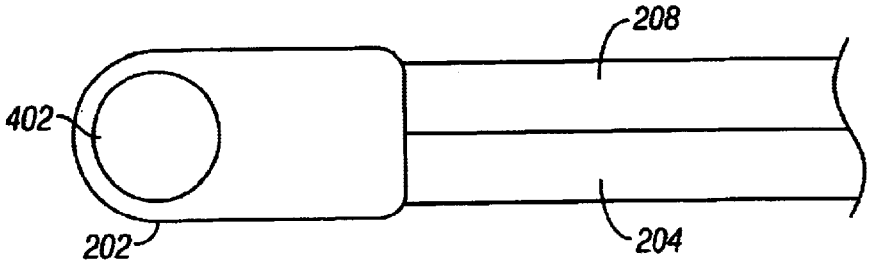
FIG. 4 shows a bottom view of a boom in accordance with an embodiment of the invention.

FIG. 4 shows a bottom view of an exemplary boom in accordance with an embodiment of the invention. Concave area 402 may be thinned to reduce the weight of plastic wind noise reducer 202, reducing the overall weight of boom 104. In an embodiment, concave area 402 may be thinned to about 2.4 mm. In another embodiment of the invention, area 402 may remain filled if boom weight reduction is not required or desired.

Figure 5:
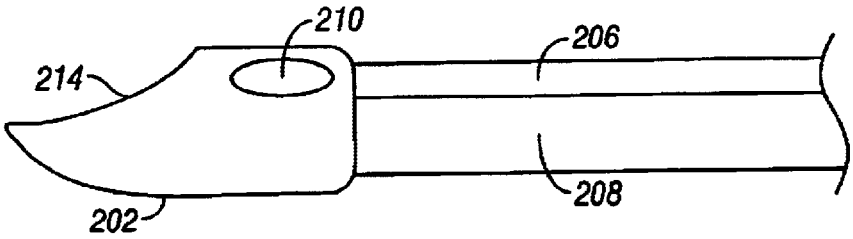
FIG. 5 shows a side view of a boom in accordance with an embodiment of the invention.

FIG. 5 shows a side view of an exemplary boom in accordance with an embodiment of the invention. Concave area of end 214 may be arched towards light tube 206 to expose an increased portion of the plastic surface of end 214 to the light emitted by the LED.

Figure 6:
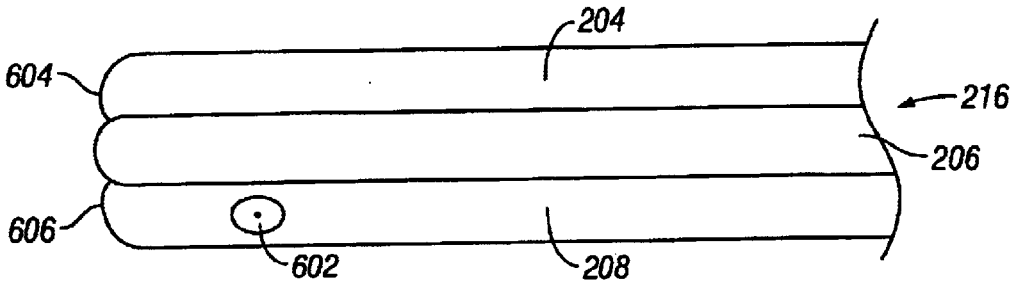
FIG. 6 shows a detailed perspective view of an exemplary embodiment of the sound tubes and light tube.

FIG. 6 shows a detailed top view of an exemplary embodiment of the boom. Sound entry points 604 and 602 allow sound waves to enter tubes 204, 208. In an exemplary embodiment, sound entry point 602 may be recessed or staggered about 13 mm away from sound entry point 604. Sound entry point 602 is recessed so as to create improved noise cancellation properties, as well known to one of ordinary skill in the art.

In an embodiment, a material may be used to block sound entry point 606, such as Thermo-Plastic Elastomer 30A, or other similar materials to prevent sound waves from entering sound tube 208. This blockage allows sound waves to enter only through sound entry point 602.

Sound waves from a user's voice may be received at ends 604, 602 of voice tubes 204, 208, which are covered or housed by a wind noise reducer. A sound wave entering the voice tube 204 at aperture 604 may be transmitted through voice tube 204 to the front of the microphone. Sound entering noise canceling tube 208 at aperture 602 may be transmitted through the noise canceling tube 208 to the back of the microphone. The difference in the sound waves reaching each side of a diaphragm associated with the microphone creates proper noise cancellation. In an embodiment, each tube 204, 208 may have an internal diameter of about 1.3 mm and a length of about 120 mm.

Referring again to FIG. 3, in an exemplary embodiment of the invention, the porous plastic material of noise reducer 202 includes about 40 percent void volume and 60 percent plastic volume. The void volume may be composed of air or space. Localized acoustic dampening areas 210, 212 may be either thinned to obtain lesser acoustic dampening, or thickened to obtain more acoustic dampening. In an exemplary embodiment, localized acoustic dampening areas 210, 212 are thinned to about 2.4 mm. Wind noise reducer 202 covers the apertures or sound ports to sound tubes 204, 208.

Figure 7:
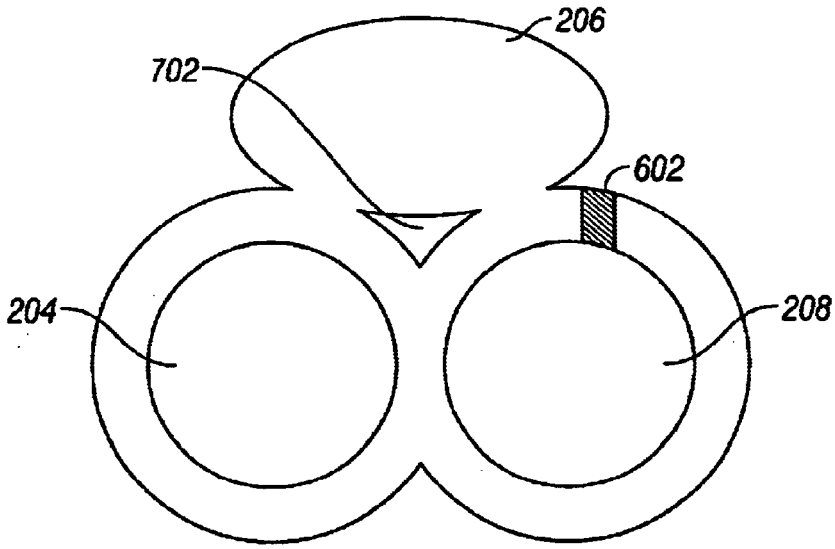
FIG. 7 shows a cross-sectional view of an exemplary boom in accordance with an embodiment of the invention.

FIG. 7 shows a cross-sectional of an exemplary boom in accordance with an embodiment of the invention. Light tube 206 may be formed from an extrusion process, which is known in the art, to obtain a more cylindrical shape. To increase the amount of light that propagates through a medium, light tube 206 is adapted to reflect light off the inside walls of the medium at acute angles. In one embodiment, light tube 206 is made of a relatively cylindrical shape having a lack of shark bends to allow light to reflect at acute angles. Increased divergence from a cylindrical shape may increase light reflection out of the medium and/or absorption into the medium as heat.

In an embodiment, boom 104 may be extruded such that empty space 702 aids in the propagation of light from the LED through light tube 206. The cylindrical shape of light tube 206 may be adjusted to control the amount of light propagating through the medium and satisfy structural strength requirements.

In an exemplary embodiment, light tube 206 and sound tubes 204, 208 may be manufactured by a process such as extrusion. Other manufacturing processes such as injection molding may be used, along with other such manufacturing processes known to one of ordinary skill in the art.

Figure 8:
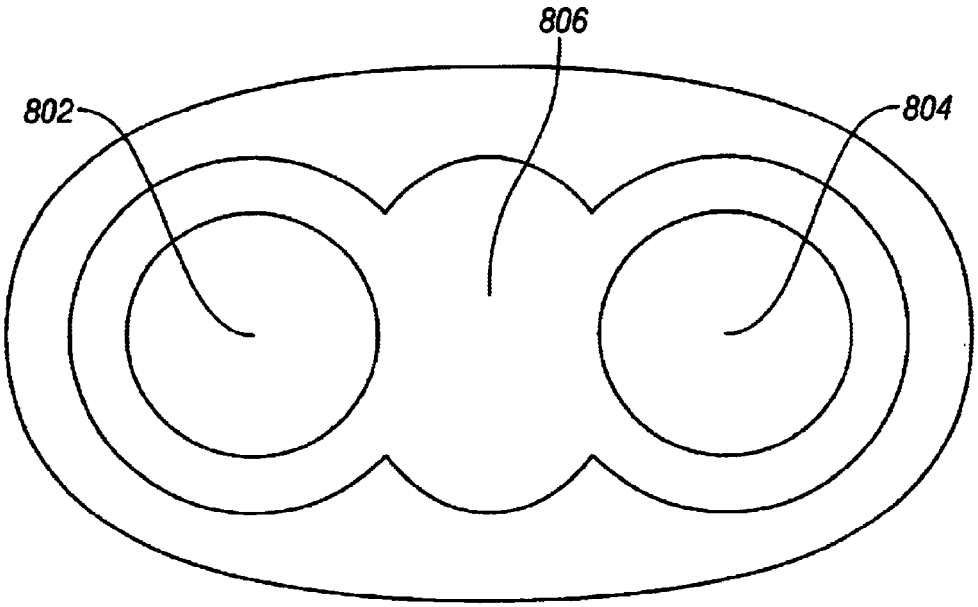
FIG. 8 shows a cross-sectional view of an exemplary boom in accordance with another embodiment of the invention.

FIG. 8 shows a cross-sectional view of an exemplary boom in accordance with another embodiment of the invention. Sound tubes 802, 804 flank light tube 806. It will be appreciated by one of ordinary skill in the art that other light and sound tube configurations may also be implemented without undue experimentation.

Various modifications to the preferred embodiments will be readily apparent to those skilled in the art, and the general principles defined herein may be applied to other embodiments and applications without departing from the spirit and scope of the invention. Thus, the present invention is not intended to be limited to the embodiments shown, but is to be accorded the widest scope consistent with the principles and features disclosed herein.

What is claimed is:

1. A boom adapted for use with or in a headset comprising:

a voice tube having a first entry aperture;

a light tube;

a noise reducer covering at least in part at least one member selected from the group consisting of the voice tube, a noise canceling tube, and the light tube; and the noise canceling tube having a second entry aperture staggered in relation to the first entry aperture in a direction along a length of the noise canceling tube.

2. The boom of claim 1, wherein the noise reducer is at least in part composed of a porous plastic material.

3. The boom of claim 1, wherein the light tube is adapted to transmit light from an online indicator light source.

4. A boom adapted for use with or in a headset comprising:

a voice tube having a first entry aperture;

a light tube; and a noise reducer at least partly covering at least one member selected from the group consisting of the voice tube and the light tube, the noise reducer being at least in part composed of a porous plastic material that includes at least one of a concave area and a localized acoustic dampening area.

5. The boom of claim 4, wherein the porous plastic material includes the concave area and wherein the concave area is thinned.

6. The boom of claim 4, wherein the porous plastic material includes the concave area and wherein the concave area points toward the light tube.

7. The boom of claim 2, wherein the porous plastic material is between about 30 percent and about 50 percent void volume.

8. The boom of claim 4, wherein the porous plastic material includes at least one localized acoustic dampening area and wherein the at least one localized acoustic dampening area is thickened to achieve increased acoustic dampening.

9. The boom of claim 4, wherein the porous plastic material includes at least one localized acoustic dampening area and wherein the at least one localized acoustic dampening area is thinned to achieve decreased acoustic dampening.

10. The boom of claim 4, wherein the porous plastic material includes at least one localized acoustic dampening area and wherein the at least one localized acoustic dampening area is thinned to between about 2 mm and about 3 mm.

11. A communication apparatus for receiving acoustic signals from a desired acoustic source comprising:

a light source; and a boom, wherein the boom includes:

a light tube coupled to the light source;

a voice tube having a first entry aperture;

a noise reducer covering at least in part at least one member selected from the group consisting of the voice tube, a noise canceling tube, and the light tube; and the noise canceling tube having a second entry aperture staggered in relation to the first entry aperture in a direction along a length of the noise canceling tube.

12. The communication apparatus of claim 11, wherein the light source is an LED.

13. The communication apparatus of claim 11, wherein the noise reducer is at least in part composed of a porous plastic material.

14. A communication apparatus for receiving acoustic signals from a desired acoustic source comprising:

a light source; and a boom, wherein the boom includes:

a light tube coupled to the light source;

a voice tube having a first entry aperture; and a noise reducer at least partly covering at least one member selected from the group consisting of the voice tube and the light tube, the noise reducer being at least in part composed of a porous plastic material that includes at least one of a thinned concave area and a localized thinning area.

15. The communication apparatus of claim 14, wherein the porous plastic material includes between about 30 percent and about 50 percent void volume.

16. The communication apparatus of claim 14, wherein the porous plastic material includes at least one localized thinning area.

17. The communication apparatus of claim 11, wherein the communication apparatus is a headset.

* * * * *